US011840062B2

(12) United States Patent
Utsunomiya et al.

(10) Patent No.: US 11,840,062 B2
(45) Date of Patent: Dec. 12, 2023

(54) THREE-DIMENSIONAL OBJECT PRINTING METHOD AND APPARATUS

(71) Applicant: SEIKO EPSON CORPORATION, Tokyo (JP)

(72) Inventors: Kohei Utsunomiya, Matsumoto (JP); Tomonaga Hasegawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/809,236

(22) Filed: Jun. 27, 2022

(65) Prior Publication Data

US 2022/0410466 A1 Dec. 29, 2022

(30) Foreign Application Priority Data

Jun. 28, 2021 (JP) ..... 2021-106769

(51) Int. Cl.
*B41J 11/00* (2006.01)
*B41J 3/407* (2006.01)

(52) U.S. Cl.
CPC ..... *B41J 11/00218* (2021.01); *B41J 3/4073* (2013.01); *B41J 11/00212* (2021.01); *B41J 11/00214* (2021.01)

(58) Field of Classification Search
CPC ..... B41J 11/00218; B41J 3/4073; B41J 11/00212; B41J 11/00214; B41J 11/0021; B41J 25/00
See application file for complete search history.

(56) References Cited

U.S. PATENT DOCUMENTS

2014/0063096 A1* 3/2014 Pitz ..... B41J 11/002 347/9

FOREIGN PATENT DOCUMENTS

JP 2014-050832 3/2014

* cited by examiner

*Primary Examiner* — Bradley W Thies
(74) *Attorney, Agent, or Firm* — WORKMAN NYDEGGER

(57) ABSTRACT

A three-dimensional object printing method includes first operation of concurrently performing ejection of liquid toward a workpiece by a head, emission of energy toward the workpiece by an energy emitter, and movement of the head and the energy emitter with respect to the workpiece by a moving mechanism, and second operation of concurrently performing emission of energy toward the workpiece by the energy emitter and movement of the head and the energy emitter with respect to the workpiece by the moving mechanism, without performing ejection of liquid by the head. A first irradiation distance, which is a distance between the workpiece and an emission face during execution of the first operation, and a second irradiation distance, which is a distance between the workpiece and the emission face during execution of the second operation, are different from each other.

17 Claims, 10 Drawing Sheets

THREE-DIMENSIONAL OBJECT PRINTING METHOD AND APPARATUS

The present application is based on, and claims priority from JP Application Serial Number 2021-106769, filed Jun. 28, 2021, the disclosure of which is hereby incorporated by reference herein in its entirety.

BACKGROUND

1. Technical Field

The present disclosure relates to a three-dimensional object printing method and apparatus.

2. Related Art

A three-dimensional object printing apparatus that performs printing on a surface of a three-dimensional workpiece using an ink-jet technique is known. For example, an apparatus disclosed in JP-A-2014-050832 includes a robot arm, and a print head and an ultraviolet radiation device that are fixed to the distal end of the robot arm, and prints an image on a target object using ink ejected from the print head. The ultraviolet radiation device emits ultraviolet light for curing ink on the target object.

Though there is no specific description in JP-A-2014-050832 about UV radiation on ink on the target object, ink should be cured properly.

SUMMARY

A three-dimensional object printing method according to a certain aspect of the present disclosure is a method using a head, an energy emitter, and a moving mechanism, the head having an ejection face in which a nozzle for ejecting liquid is provided, the energy emitter having an emission face from which energy for curing or solidifying the liquid ejected from the head is emitted, the moving mechanism changing relative position of the head and the energy emitter with respect to a three-dimensional workpiece, the three-dimensional object printing method comprising: first operation of concurrently performing ejection of liquid toward the workpiece by the head, emission of energy toward the workpiece by the energy emitter, and relative movement of the head and the energy emitter with respect to the workpiece by the moving mechanism; and second operation, subsequent to the first operation, of concurrently performing emission of energy toward the workpiece by the energy emitter and relative movement of the head and the energy emitter with respect to the workpiece by the moving mechanism, without performing ejection of liquid toward the workpiece by the head; wherein a first irradiation distance, which is a distance between the workpiece and the emission face in a direction of a line normal to the emission face during execution of the first operation, and a second irradiation distance, which is a distance between the workpiece and the emission face in a direction of a line normal to the emission face during execution of the second operation, are different from each other.

A three-dimensional object printing method according to another aspect of the present disclosure is a method using a head, an energy emitter, and a moving mechanism, the head having an ejection face in which a nozzle for ejecting liquid is provided, the energy emitter having an emission face from which energy for curing or solidifying the liquid ejected from the head is emitted, the moving mechanism changing relative position of the head and the energy emitter with respect to a three-dimensional workpiece, the three-dimensional object printing method comprising: first operation of concurrently performing ejection of liquid toward the workpiece by the head, emission of energy toward the workpiece by the energy emitter, and relative movement of the head and the energy emitter with respect to the workpiece by the moving mechanism; and second operation, subsequent to the first operation, of concurrently performing emission of energy toward the workpiece by the energy emitter and relative movement of the head and the energy emitter with respect to the workpiece by the moving mechanism, without performing ejection of liquid toward the workpiece by the head; wherein a first angle, which is an angle formed by the ejection face and a face of the workpiece facing the ejection face during execution of the first operation, and a second angle, which is an angle formed by the ejection face and the face of the workpiece facing the ejection face during execution of the second operation, are different from each other.

A three-dimensional object printing apparatus according to a certain aspect of the present disclosure includes: a head having an ejection face in which a nozzle for ejecting liquid is provided; an energy emitter having an emission face from which energy for curing or solidifying the liquid ejected from the head is emitted; and a moving mechanism changing relative position of the head and the energy emitter with respect to a three-dimensional workpiece, wherein first operation is performed, the first operation being an operation of concurrently performing ejection of liquid toward the workpiece by the head, emission of energy toward the workpiece by the energy emitter, and relative movement of the head and the energy emitter with respect to the workpiece by the moving mechanism, and second operation subsequent to the first operation is performed, the second operation being an operation of concurrently performing emission of energy toward the workpiece by the energy emitter and relative movement of the head and the energy emitter with respect to the workpiece by the moving mechanism, without performing ejection of liquid toward the workpiece by the head, and a first irradiation distance, which is a distance between the workpiece and the emission face in a direction of a line normal to the emission face during execution of the first operation, and a second irradiation distance, which is a distance between the workpiece and the emission face in a direction of a line normal to the emission face during execution of the second operation, are different from each other.

DESCRIPTION OF EXEMPLARY EMBODIMENTS

Figure 1:
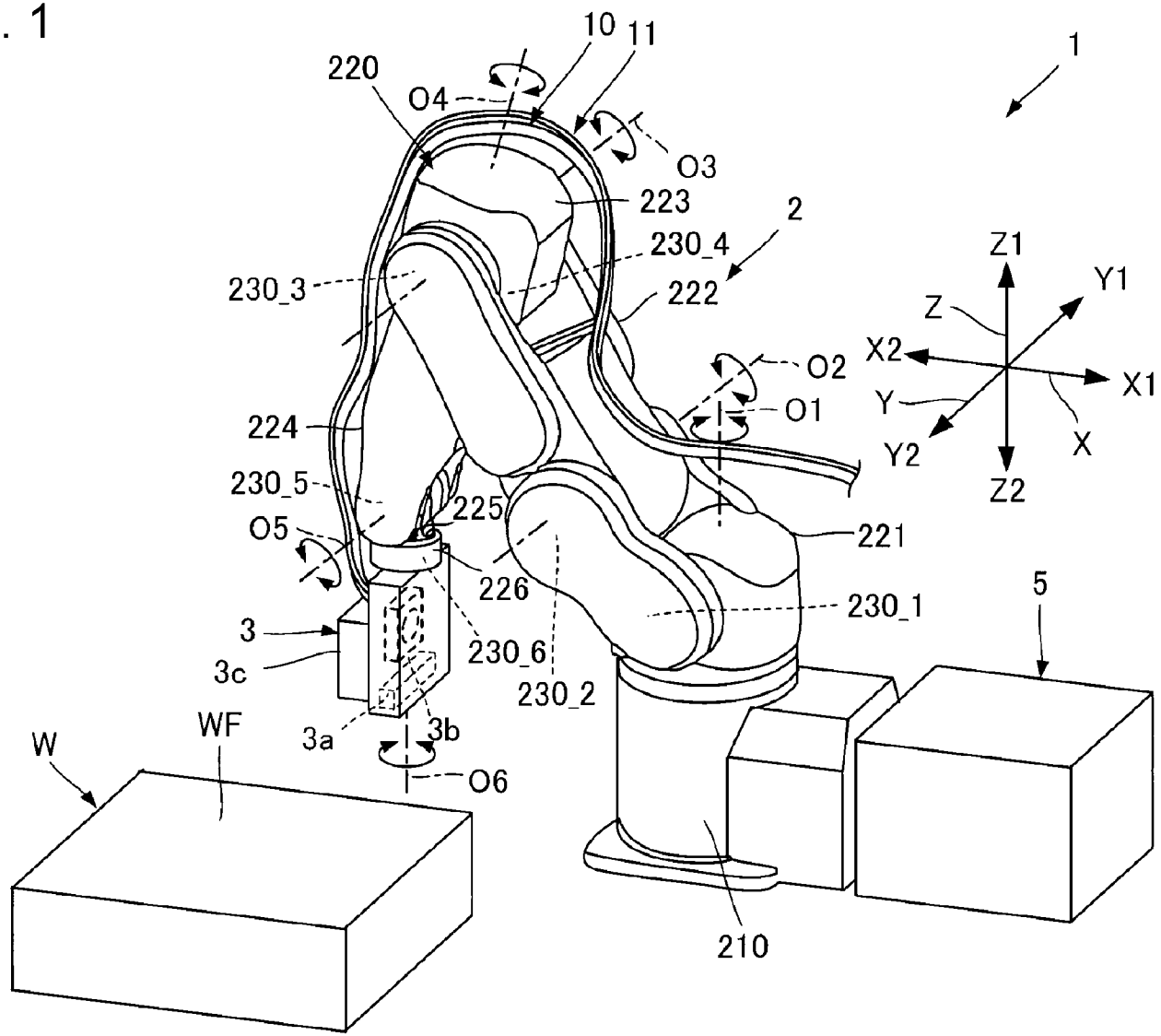
FIG. 1 is a schematic perspective view of a three-dimensional object printing apparatus according to a first embodiment.

With reference to the accompanying drawings, some preferred embodiments of the present disclosure will now be described. The dimensions and scales of components illustrated in the drawings may be different from actual dimensions and scales, and some components may be schematically illustrated for easier understanding. The scope of the present disclosure shall not be construed to be limited to the specific embodiments described below unless and except where the description contains an explicit mention of an intent to limit the present disclosure.

To facilitate the readers' understanding, the description below will be given with reference to X, Y, and Z axes intersecting with one another. In the description below, one direction along the X axis will be referred to as the X1 direction, and the direction that is the opposite of the X1 direction will be referred to as the X2 direction. Similarly, directions that are the opposite of each other along the Y axis will be referred to as the Y1 direction and the Y2 direction. Directions that are the opposite of each other along the Z axis will be referred to as the Z1 direction and the Z2 direction.

The X, Y, and Z axes correspond to coordinate axes of a world coordinate system set in a space in which a robot 2 to be described later is installed. Typically, the Z axis is a vertical axis, and the Z2 direction corresponds to a vertically-downward direction. A base coordinate system based on the position of a pedestal portion 210, which will be described later, of the robot 2 is associated with the world coordinate system by calibration. In the description below, for the purpose of explanation, a case where the operation of the robot 2 is controlled using the world coordinate system as a robot coordinate system will be taken as an example.

The Z axis does not necessarily have to be a vertical axis. The X, Y, and Z axes are typically orthogonal to one another, but are not limited thereto; they could be mutually non-orthogonal axes. For example, it is sufficient as long as the X, Y, and Z axes intersect with one another within an angular range of 80° or greater and 100° or less.

1. First Embodiment

1-1. Overview of Three-Dimensional Object Printing Apparatus

FIG. 1 is a schematic perspective view of a three-dimensional object printing apparatus 1 according to a first embodiment. The three-dimensional object printing apparatus 1 is an apparatus that performs ink-jet printing on a surface of a three-dimensional workpiece W.

The workpiece W has a face WF on which printing is to be performed. In the example illustrated in FIG. 1, the workpiece W has a shape of a rectangular parallelepiped, and the face WF is a flat surface. The workpiece W during the process of printing is supported by a predetermined structural supporter such as, for example, a workpiece placement table, a robot hand, or a conveyor as may be necessary. The size, shape, etc. of the workpiece W, and the face WF thereof, is not limited to the example illustrated in FIG. 1. The workpiece W, and/or the face WF thereof, may have any size, shape, etc. For example, the face WF may have a curved portion or a bent portion. Moreover, the position of the workpiece W during the process of printing, and the face WF thereof, is not limited to the example illustrated in FIG. 1, and may be at any position as long as the printing can be performed. The orientation of the workpiece W during the process of printing, and the face WF thereof, is also not limited to the example illustrated in FIG. 1, and may be in any orientation as long as the printing can be performed.

As illustrated in FIG. 1, the three-dimensional object printing apparatus 1 includes the robot 2, which is an example of "moving mechanism", a head unit 3, a controller 5, a tubing portion 10, and a wiring portion 11. First, these components will now be explained briefly in a sequential manner.

The robot 2 is a machine that changes the position and orientation of the head unit 3 in the world coordinate system. In the example illustrated in FIG. 1, the robot 2 is a so-called six-axis vertical articulated robot.

As illustrated in FIG. 1, the robot 2 includes a pedestal portion 210 and an arm portion 220.

The pedestal portion 210 is a base column that supports the arm portion 220. In the example illustrated in FIG. 1, the pedestal portion 210 is fastened with screws, etc. to an installation plane such as a floor or a table, etc. facing in the Z1 direction. The pedestal portion 210 is an example of a base portion. The installation plane to which the pedestal portion 210 is fixed may be oriented in any direction. For example, the pedestal portion 210 may be installed on a wall, on a ceiling, on the surface of a wheeled platform, or the like, without any limitation to the example illustrated in FIG. 1.

The arm portion 220 is a six-axis robot arm module that has a base end mounted on the pedestal portion 210 and a distal end whose position and orientation are configured to change three-dimensionally in relation to the base end. Specifically, the arm portion 220 includes arms 221, 222, 223, 224, 225, and 226, which are called also as links. They are coupled to one another sequentially in this order.

The arm 221 is coupled to the pedestal portion 210 via a joint 230_1 in such a way as to be able to rotate around a rotation axis O1. The arm 222 is coupled to the arm 221 via a joint 230_2 in such a way as to be able to rotate around a rotation axis O2. The arm 223 is coupled to the arm 222 via a joint 230_3 in such a way as to be able to rotate around a rotation axis O3. The arm 224 is coupled to the arm 223 via a joint 230_4 in such a way as to be able to rotate around a rotation axis O4. The arm 225 is coupled to the arm 224 via a joint 230_5 in such a way as to be able to rotate around a rotation axis O5. The arm 226 is coupled to the arm 225 via a joint 230_6 in such a way as to be able to rotate around a rotation axis O6.

Each of the joints 230_1 to 230_6 is an example of "rotatable portion" and is a mechanism that couples, among the pedestal portion 210 and the arms 221 to 226, one of two that are kinetically adjacent to each other to the other in a rotatable manner. In the description below, each of the joints 230_1 to 230_6 may be referred to as "joint 230" without making any distinction therebetween.

On each of the joints 230_1 to 230_6, a driving mechanism that causes one of corresponding two mutually-adjacent members to rotate in relation to the other is provided, though not illustrated in FIG. 1. The driving mechanism includes, for example, a motor that generates a driving force for the rotation, a speed reducer that performs speed reduction on the driving force and outputs the reduced force, and an encoder such as a rotary encoder that detects the amount of operation such as the angle of the rotation. A collective set of the driving mechanisms provided respectively on the joints 230_1 to 230_6 corresponds to an arm driving mechanism 2*a*, which will be described later with reference to FIG. 2.

The rotation axis O1 is an axis that is perpendicular to the non-illustrated installation plane to which the pedestal portion 210 is fixed. The rotation axis O2 is an axis that is perpendicular to the rotation axis O1. The rotation axis O3 is an axis that is parallel to the rotation axis O2. The rotation axis O4 is an axis that is perpendicular to the rotation axis O3. The rotation axis O5 is an axis that is perpendicular to the rotation axis O4. The rotation axis O6 is an axis that is perpendicular to the rotation axis O5.

With regard to these rotation axes, the meaning of the word "perpendicular" is not limited to a case where the angle formed by two rotation axes is exactly 90°. In addition to such exact perpendicularity, the meaning of the word "perpendicular" encompasses cases where the angle formed by two rotation axes is within a range of approximately ±5° from 90°. Similarly, the meaning of the word "parallel" is not limited to a case where two rotation axes are exactly parallel to each other, but also encompasses cases where one of the two rotation axes is inclined with respect to the other within a range of approximately ±5°.

On the arm 226, which is the most distal one of the arms of the arm portion 220 of the robot 2, the head unit 3 is mounted as an end effector and is fastened with screws, etc.

The head unit 3 is an assembly that has a head 3*a* configured to eject ink, which is an example of "liquid", toward the workpiece W. In the present embodiment, besides the head 3*a*, the head unit 3 includes a pressure adjustment valve 3*b* and an energy emitter 3*c*. The head unit 3 will be described in detail later with reference to FIG. 3.

The ink is not limited to any specific kind of ink. Examples of the ink include water-based ink in which a colorant such as dye or pigment is dissolved in a water-based dissolvent, curable ink using curable resin such as ultraviolet curing resin, solvent-based ink in which a colorant such as dye or pigment is dissolved in an organic solvent. Among them, curable ink can be used as a preferred example. The type of the curable ink is not specifically limited. For example, any of thermosetting ink, photo-curable ink, radiation-curable ink, electron-beam-curable ink, and the like, may be used. A preferred example is photo-curable ink such as ultraviolet curing ink. The ink is not limited to a solution and may be formed by dispersion of a colorant or the like as a dispersoid in a dispersion medium. The ink is not limited to colorant-containing ink. For example, the ink may contain, as a dispersoid, conductive particles such as metal particles for forming wiring lines, etc. Alternatively, the ink may be clear ink, or process liquid for surface treatment of the workpiece W.

The tubing portion 10 and the wiring portion 11 are connected to the head unit 3. The tubing portion 10 is a tube through which ink is supplied from a non-illustrated ink tank to the head unit 3, or a group of such tubes. The wiring portion 11 is a wire through which an electric signal for driving the head 3*a* is supplied, or a group of such wires.

Figure 2:
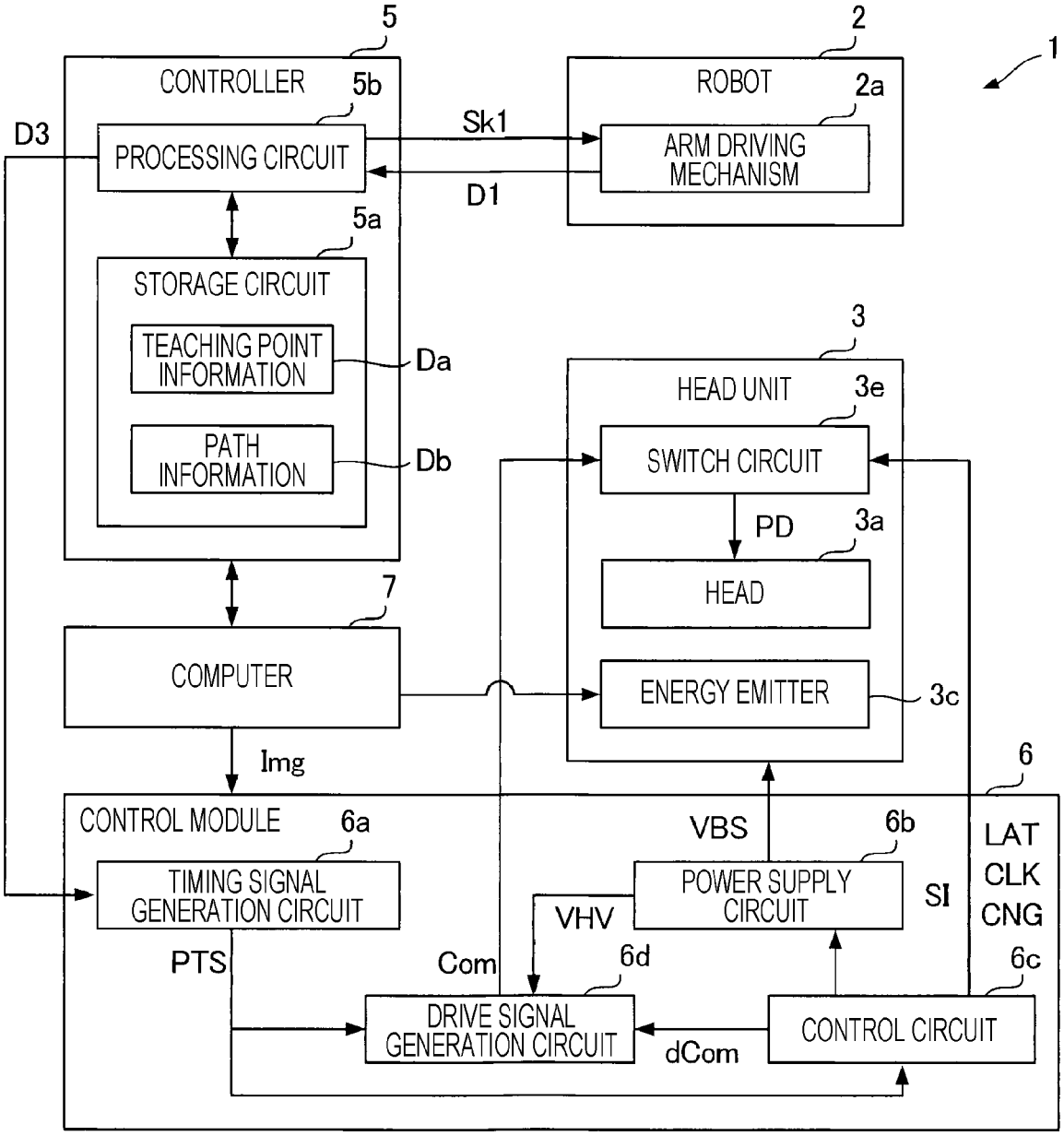
FIG. 2 is a block diagram that illustrates the electric configuration of a three-dimensional object printing apparatus according to the first embodiment.

The controller 5 is a robot controller that controls the driving of the robot 2. With reference to FIG. 2, the electric configuration of the three-dimensional object printing apparatus 1 will be described below, including a detailed explanation of the controller 5.

1-2. Electric Configuration of Three-Dimensional Object Printing Apparatus

FIG. 2 is a block diagram that illustrates the electric configuration of the three-dimensional object printing apparatus 1 according to the first embodiment. In FIG. 2, among the components of the three-dimensional object printing apparatus 1, electric components are illustrated. As illustrated in FIG. 2, besides the components described above with reference to FIG. 1, the three-dimensional object printing apparatus 1 includes a control module 6 communicably connected to the controller 5, and a computer 7 communicably connected to the controller 5 and the control module 6.

Any of electric components illustrated in FIG. 2 may be split into two or more subcomponents as needed. A part of one electric component illustrated in FIG. 2 may be included in another one. One electric component illustrated in FIG. 2 may be integrated with another one. For example, a part or a whole of the functions of the controller 5 or the control module 6 may be embodied by the computer 7, or by an external device such as a personal computer (PC) connected to the controller 5 via a network such as a local area network (LAN) or the Internet.

The controller 5 has a function of controlling the driving of the robot 2 and a function of generating a signal D3 for synchronizing the ejection of ink by the head unit 3 with the operation of the robot 2.

The controller 5 includes a storage circuit 5*a* and a processing circuit 5*b*.

The storage circuit 5*a* stores various programs that are to be run by the processing circuit 5*b* and various kinds of data that are to be processed by the processing circuit 5*b*. The storage circuit 5*a* includes, for example, a semiconductor memory that is either one of a volatile memory such as, for example, a random-access memory (RAM), and a nonvolatile memory such as, for example, a read-only memory (ROM), an electrically erasable programmable read-only memory (EEPROM), or a programmable ROM (PROM), or includes semiconductor memories constituted by both of them. A part or a whole of the storage circuit 5*a* may be included in the processing circuit 5*b*.

Teaching point information Da and path information Db are stored in the storage circuit 5*a*. The teaching point information Da is information that indicates a plurality of positions on a path along which the head unit 3 is to move and indicates the orientation of the head unit 3 at each of the plurality of positions. The teaching point information Da is generated based on, for example, information acquired by direct teaching or offline teaching, etc. The teaching point information Da is expressed using, for example, the coordinate values of the base coordinate system or the world coordinate system. The path information Db is information that indicates the path along which the head unit 3 is to move and indicates the orientation of the head unit 3 on the path. The path information Db is generated using the teaching point information Da. More specifically, the path information Db is generated using, for example, the shape of the workpiece W, etc., in addition to the teaching point information Da. The path information Db is expressed using, for example, the coordinate values of the base coordinate system or the world coordinate system. The shape of the workpiece W is obtained in the form of, for example, computer-aided design (CAD) data that represents the three-dimensional shape of the workpiece W. The path information Db described above is inputted from the computer 7 into the storage circuit 5*a*.

Based on the path information Db, the processing circuit 5*b* controls the operation of the arm driving mechanism 2*a* of the robot 2 and generates the signal D3. The processing circuit 5*b* includes one or more processors such as, for example, central processing unit (CPU). Instead of the CPU or in addition to the CPU, the processing circuit 5*b* may include a programmable logic device such as, for example, field-programmable gate array (FPGA).

The arm driving mechanism 2*a* is a collective set of the driving mechanisms provided respectively on the joints 230_1 to 230_6 described earlier. For each of these joints, the arm driving mechanism 2*a* includes a motor for driving this joint of the robot 2 and an encoder for detecting the rotation angle of this joint of the robot 2.

The processing circuit 5*b* performs inverse kinematics calculation that is a computation for converting the path information Db into the amount of operation such as the angle of rotation and the speed of rotation, etc. of each of the joints of the robot 2. Then, based on an output D1 from each of the encoders of the arm driving mechanism 2*a*, the processing circuit 5*b* outputs a control signal Sk1 such that the actual amount of operation such as the actual angle of rotation and the actual speed of rotation, etc. of each of the joints will be equal to the result of the computation that is based on the path information Db. The control signal Sk1 is a signal for controlling the driving of the motor of the arm driving mechanism 2*a*. Based on an output from a non-illustrated distance sensor, the control signal Sk1 is corrected by the processing circuit 5*b* as may be necessary.

Based on the output D1 from at least one of the plurality of encoders of the arm driving mechanism 2*a*, the processing circuit 5*b* generates the signal D3. For example, the processing circuit 5*b* generates, as the signal D3, a trigger signal that includes a pulse of timing at which the value of the output D1 from at least one of the plurality of encoders becomes a predetermined value.

The control module 6 is a circuit that controls, based on the signal D3 outputted from the controller 5 and print data outputted from the computer 7, the ink-ejecting operation of the head unit 3. The control module 6 includes a timing signal generation circuit 6*a*, a power supply circuit 6*b*, a control circuit 6*c*, and a drive signal generation circuit 6*d*.

Based on the signal D3, the timing signal generation circuit 6*a* generates a timing signal PTS. The timing signal generation circuit 6*a* is, for example, a timer configured to start the generation of the timing signal PTS when triggered by the detection of the signal D3.

The power supply circuit 6*b* receives power supply from a commercial power source that is not illustrated, and generates various predetermined levels of voltage. The various voltages generated by the power supply circuit 6*b* are supplied to components of the control module 6 and the head unit 3. For example, the power supply circuit 6*b* generates a power voltage VHV and an offset voltage VBS. The offset voltage VBS is supplied to the head unit 3. The power voltage VHV is supplied to the drive signal generation circuit 6*d*.

Based on the timing signal PTS, the control circuit 6*c* generates a control signal SI, a waveform specifying signal dCom, a latch signal LAT, a clock signal CLK, and a change signal CNG. These signals are in synchronization with the timing signal PTS. Among these signals, the waveform specifying signal dCom is inputted into the drive signal generation circuit 6*d*. The rest of them are inputted into a switch circuit 3*e* of the head unit 3.

The control signal SI is a digital signal for specifying the operation state of the drive element of the head 3*a* of the head unit 3. Specifically, based on the print data, the control signal SI specifies whether to supply a drive signal Com, which will be described later, to the drive element or not. For example, the control signal SI specifies whether to eject ink from the nozzle corresponding to this drive element or not and specifies the amount of ink ejected from this nozzle. The waveform specifying signal dCom is a digital signal for specifying the waveform of the drive signal Com. The latch signal LAT and the change signal CNG are used together with the control signal SI and specify the timing of ejection of ink from the nozzle by specifying the drive timing of the drive element. The clock signal CLK serves as a reference clock that is in synchronization with the timing signal PTS.

The control circuit 6*c* described above includes one or more processors, for example, central processing unit (CPU). Instead of the CPU or in addition to the CPU, the control circuit 6*c* may include a programmable logic device, for example, field-programmable gate array (FPGA).

The drive signal generation circuit 6*d* is a circuit that generates the drive signal Com for driving each drive element of the head 3*a* of the head unit 3. Specifically, the drive signal generation circuit 6*d* includes, for example, a DA conversion circuit and an amplification circuit. In the drive signal generation circuit 6*d*, the DA conversion circuit converts the format of the waveform specifying signal dCom supplied from the control circuit 6*c* from a digital signal into an analog signal, and the amplification circuit amplifies the analog signal by using the power voltage VHV supplied from the power supply circuit 6*b*, thereby generating the drive signal Com. As a part of the waveform included in the drive signal Com, a signal having a waveform to be supplied actually to the drive element is a drive pulse PD. The drive pulse PD is supplied from the drive signal generation circuit 6*d* to the drive element via the switch circuit 3*e* of the head unit 3.

The switch circuit 3*e* is a circuit that includes a switching element configured to, based on the control signal SI, switch whether or not to supply at least a part of the waveform included in the drive signal Com as the drive pulse PD.

The computer 7 has a function of supplying information such as the teaching point information Da and the path information Db to the controller 5 and a function of supplying print data, etc. to the control module 6. In addition to these functions, the computer 7 according to the present embodiment has a function of controlling the driving of the energy emitter 3*c* and a function of generating the teaching point information Da and the path information Db. The computer 7 is, for example, a desktop-type or notebook-type computer in which programs for implementation of these functions are installed.

1-3. Structure of Head Unit

Figure 3:
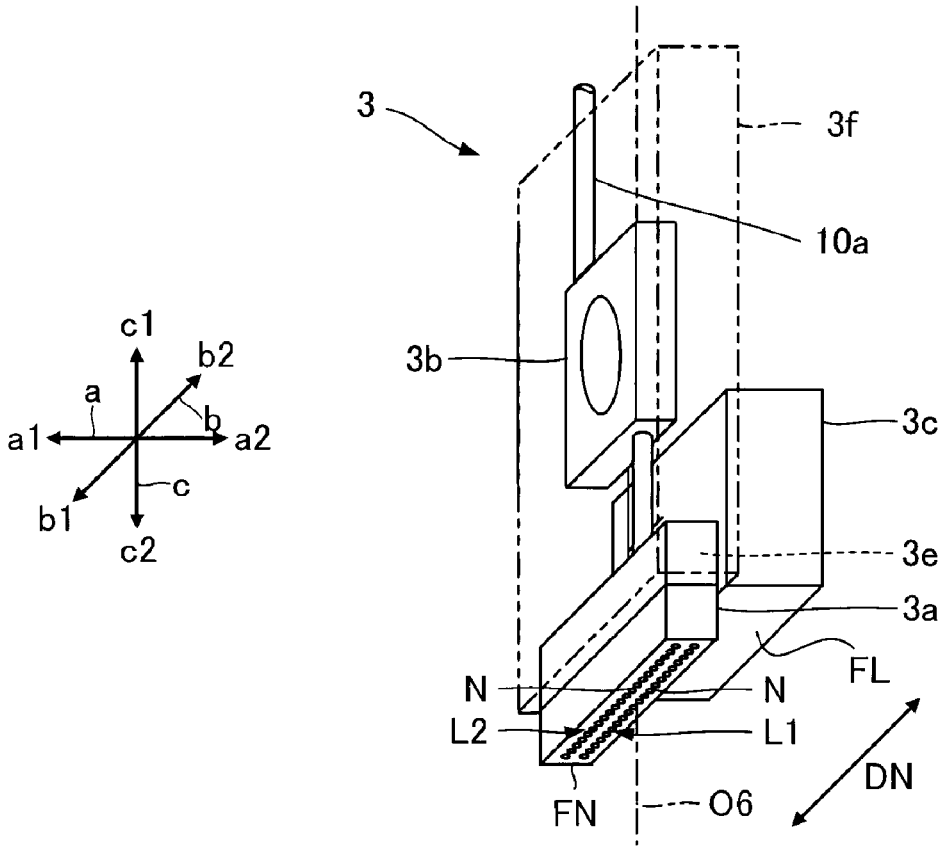
FIG. 3 is a perspective view of a schematic structure of a head unit.

FIG. 3 is a perspective view of a schematic structure of the head unit 3. To facilitate the readers' understanding, the description below will be given with reference to a, b, and c axes intersecting with one another. In the description below, one direction along the a axis will be referred to as the a1 direction, and the direction that is the opposite of the a1 direction will be referred to as the a2 direction. Similarly, directions that are the opposite of each other along the b axis will be referred to as the b1 direction and the b2 direction. Directions that are the opposite of each other along the c axis will be referred to as the c1 direction and the c2 direction.

The a, b, and c axes correspond to coordinate axes of a tool coordinate system set for the head unit 3. The position and orientation in the tool coordinate system relative to the world coordinate system or the robot coordinate system described earlier change due to the operation of the robot 2 described earlier. In the example illustrated in FIG. 3, the c axis is parallel to the rotation axis O6 described earlier. The a, b, and c axes are typically orthogonal to one another, but are not limited thereto. For example, it is sufficient as long as the a, b, and c axes intersect with one another within an angular range of 80° or greater and 100° or less. The tool coordinate system is associated with the base coordinate system or the robot coordinate system by calibration. The tool coordinate system is set such that, for example, its origin (TCP: tool center point) lies at the center of an ejection face FN, which will be described later.

As described earlier, the head unit 3 includes the head 3*a*, the pressure adjustment valve 3*b*, and the energy emitter 3*c*. These components are supported by a support member 3*f* indicated by alternate-long-and-two-short-dashes illustration in FIG. 3. In the example illustrated in FIG. 3, the head unit 3 has a single head 3*a* and a single pressure adjustment valve 3*b*. However, the number of each of them is not limited to one. The head unit 3 may have two or more heads 3*a* and/or two or more pressure adjustment valves 3*b*. The position where the pressure adjustment valve 3*b* is provided is not limited to the arm 226. For example, the pressure adjustment valve 3*b* may be provided on any other arm, etc. The pressure adjustment valve 3*b* may be provided at a fixed position with respect to the pedestal portion 210.

The support member 3*f* is made of, for example, a metal material, and is substantially rigid. In FIG. 3, the support member 3*f* has a low-profile box-like shape. However, the support member 3*f* may have any shape, without being limited to the illustrated example.

The support member 3*f* described above is mounted on the arm 226 described earlier. Therefore, the head 3*a*, the pressure adjustment valve 3*b*, and the energy emitter 3*c* are supported together by the support member 3*f* onto the arm 226. For this reason, the relative position of each of the head 3*a*, the pressure adjustment valve 3*b*, and the energy emitter 3*c* in relation to the arm 226 is fixed. In the example illustrated in FIG. 3, the pressure adjustment valve 3*b* is located at a relatively c1-side position with respect to the head 3*a*. The energy emitter 3*c* is located at a relatively a2-side position with respect to the head 3*a*.

The head 3*a* has the ejection face FN and a plurality of nozzles N formed in the ejection face FN. The ejection face FN is a nozzle face in which the nozzles N are formed. For example, the ejection face FN is a surface of nozzle plate having the nozzles N provided as through-hole orifices in a plate-like member made of silicon or metal, etc. In the example illustrated in FIG. 3, the direction of a line normal to the ejection face FN is the c2 direction, and the plurality of nozzles N is divided into a nozzle row L1 and a nozzle row L2, which are arranged next to each other, with an interval in the direction along the a axis therebetween. Each of the nozzle row L1 and the nozzle row L2 is a group of nozzles N arranged linearly in the direction along the b axis. The head 3*a* has a structure in which elements related to the respective nozzles N of the nozzle row L1 and elements related to the respective nozzles N of the nozzle row L2 are substantially symmetric to each other in the direction along the a axis. An array direction DN is parallel to the b axis.

The positions of the nozzles N belonging to the nozzle row L1 and the positions of the nozzles N belonging to the nozzle row L2 may be the same as one another, or different from one another, in the direction along the b axis. Elements related to the respective nozzles N of either the nozzle row L1 or the nozzle row L2 may be omitted. In the example described below, the positions of the nozzles N belonging to the nozzle row L1 and the positions of the nozzles N belonging to the nozzle row L2 are the same as one another in the direction along the b axis.

Though not illustrated, for each of the nozzles N individually, the head 3*a* has a piezoelectric element, which is a drive element, and a cavity, in which ink can be contained. Each of the plurality of piezoelectric elements is configured to change the internal pressure of the cavity corresponding to the piezoelectric element, and, as a result of this pressure change, ink is ejected from the nozzle corresponding to this cavity. The head 3*a* described above can be manufactured by, for example, preparing a plurality of substrates such as silicon substrates processed using etching or the like and then bonding the substrates together by means of an adhesive or the like. Instead of the piezoelectric element, a heater that heats ink inside the cavity may be used as a drive element for ejecting ink from the nozzle.

Ink is supplied to the head 3*a* described above from a non-illustrated ink tank through a supply tube 10*a* as described earlier. The pressure adjustment valve 3*b* is provided between the supply tube 10*a* and the head 3*a*.

The pressure adjustment valve 3*b* is a valve mechanism that opens and closes in accordance with the pressure of ink inside the head 3*a*. The opening and closing of this valve mechanism keeps the pressure of ink inside the head 3*a* within a predetermined negative pressure range even when a positional relationship between the head 3*a* and the non-illustrated ink tank mentioned above changes. Keeping such negative ink pressure stabilizes ink meniscus formed in each nozzle N of the head 3*a*. Good meniscus stability prevents external air from entering the nozzles N in the form of air bubbles and prevents ink from spilling out of the nozzles N. Ink flowing from the pressure adjustment valve 3*b* is distributed to a plurality of passages in the head 3*a* through non-illustrated branch passages. The ink supplied from the non-illustrated ink tank is sent into the supply tube 10*a* by a pump or the like at predetermined pressure.

The energy emitter 3*c* emits energy such as light, heat, an electron beam, or a radiation beam, etc. for curing or solidifying ink on the workpiece W. For example, when the ink has ultraviolet-curing property, the energy emitter 3*c* includes light emitting elements, etc. configured to emit ultraviolet light such as ultraviolet light emitting diodes (LEDs). The energy emitter 3*c* may include optical components such as lenses for adjusting the direction in which the energy is emitted, the range of energy emission, or the like as needed.

The energy emitter 3*c* does not necessarily have to cure, or solidify, the ink on the workpiece W completely. In this case, it is sufficient as long as the ink after the energy irradiation from the energy emitter 3*c* is cured or solidified completely by means of, for example, energy emitted from a curing light source installed separately on the installation plane on which the pedestal portion 210 of the robot 2 is installed.

1-4. Three-dimensional Object Printing Method

Figure 4:
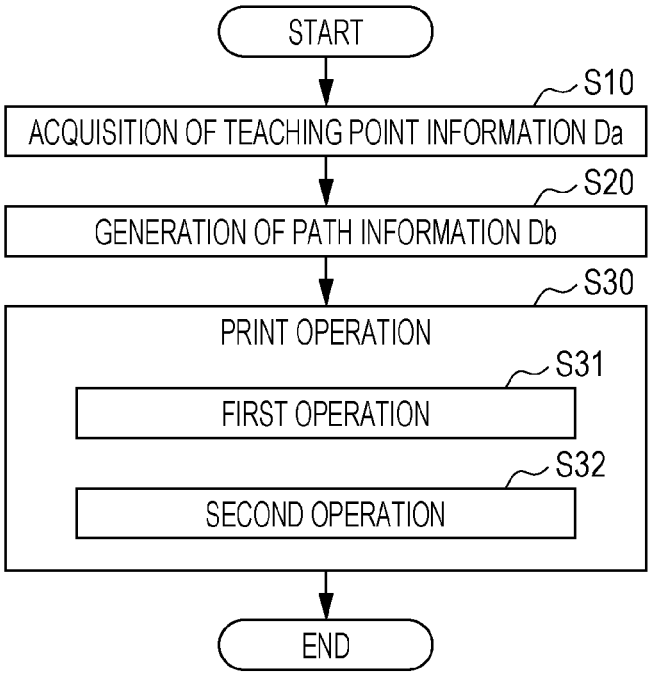
FIG. 4 is a flowchart that illustrates a three-dimensional object printing method according to the first embodiment.

FIG. 4 is a flowchart that illustrates the three-dimensional object printing method according to the first embodiment. With the above-described three-dimensional object printing apparatus 1 taken as an example, the three-dimensional object printing method will now be explained.

The three-dimensional object printing method illustrated in FIG. 4 includes a step S10 of acquiring the teaching point information Da, a step S20 of generating the path information Db using the teaching point information Da, and a step S30 of performing print operation using the path information Db. The step S30 includes first operation S31 and second operation S32. In the first operation S31, the ejection of ink from the head 3*a* toward the workpiece W and the irradiation of the workpiece W with energy emitted from the energy emitter 3*c* are performed while changing the position of the head 3*a* and the energy emitter 3*c* by the robot 2. In the second operation S32, the irradiation of the workpiece W with energy emitted from the energy emitter 3*c*, without the ejection of ink from the head 3*a* toward the workpiece W, is performed while changing the position of the head 3*a* and the energy emitter 3*c* by the robot 2. These steps will now be explained.

Figure 5:
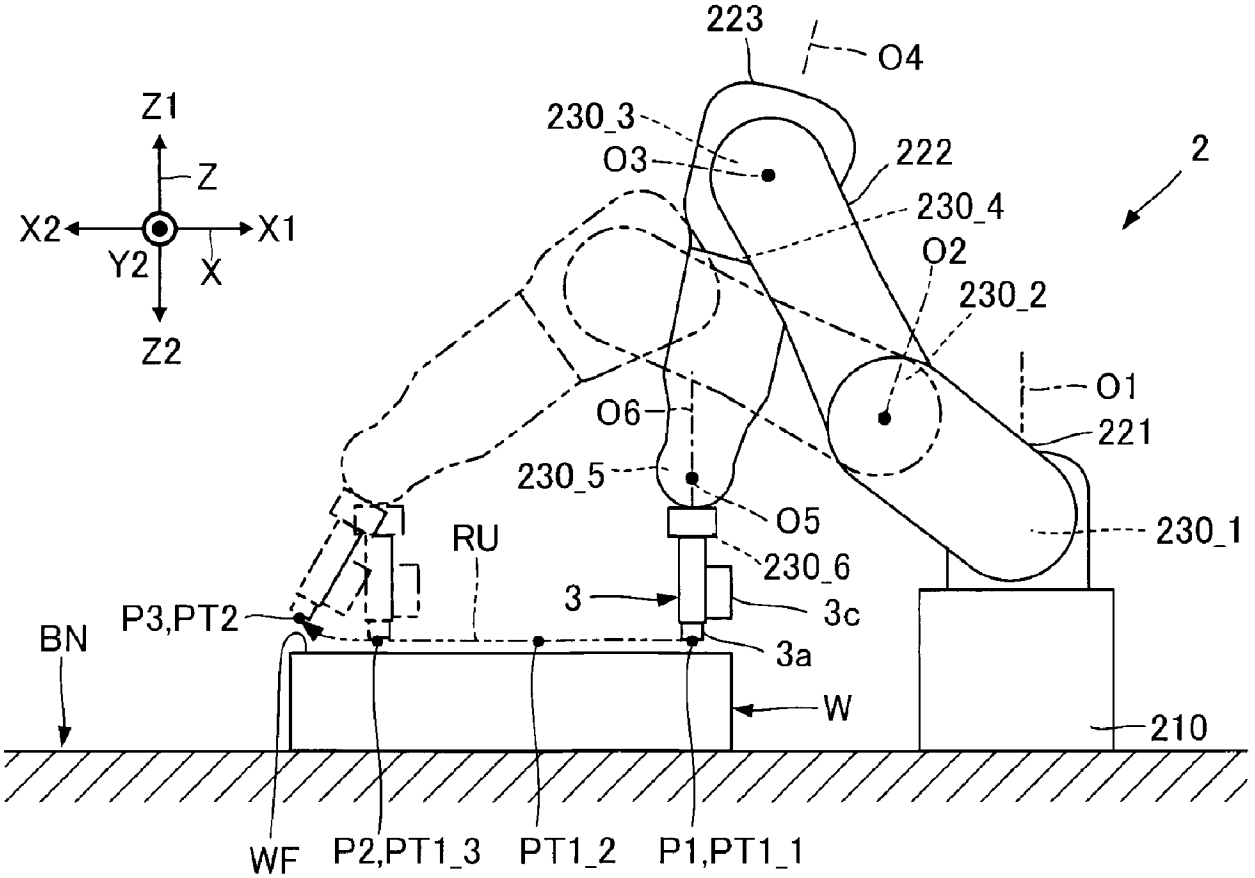
FIG. 5 is a diagram for explaining robot teaching.

FIG. 5 is a diagram for explaining the teaching of the robot 2. In FIG. 5, a case where first teaching points PT1_1 to PT1_3 and a second teaching point PT2 are used as teaching points is illustrated as an example. In the description below, each of the first teaching points PT1_1 to PT1_3 may be referred to as "the first teaching point PT1" without making any distinction therebetween. A case where a movement path RU of the head unit 3 is taught with the center of the ejection face FN taken as the TCP will be described as an example below.

First, the movement path RU of the head 3*a* that is to be taught to the robot 2 in the step S10 will be explained. A case where the face WF of the workpiece W is a flat surface orthogonal to the Z axis and where the workpiece W is placed at a relatively X2-side position with respect to the robot 2 is illustrated as an example in FIG. 5.

In print operation performed in the step S30, which will be described later, the robot 2 causes three of the six joints 230 to operate. In the example illustrated in FIG. 5, during the execution of print operation, the robot 2 causes the joints 230_2, 230_3, and 230_5 to operate in a state in which the rotation axis of each of them is parallel to the Y axis. Operating the three joints 230 in this way makes it possible to move the head 3*a* along the movement path RU stably.

The movement path RU is a path from a position P1 to a position P3. The movement path RU extends linearly along the X axis as viewed in the Z2 direction. The movement path RU is divided into sections by a position P2, namely, a path from the position P1 to the position P2 and a path from the position P2 to the position P3. The path from the position P1 to the position P2 is the movement path of the head 3*a* in the first operation S31. The path from the position P2 to the position P3 is the movement path of the head 3*a* in the second operation S32. The movement path of the head 3*a* in the second operation S32 is shorter than the movement path of the head 3*a* in the first operation S31. The first operation S31 and the second operation S32 are performed based on a command from a control unit including the controller 5, the control module 6 and the computer 7.

The distance between the path from the position P1 to the position P2 and the face WF is set to be constant. For this reason, the path from the position P1 to the position P2 is a path extending along the face WF. By contrast, the distance between the path from the position P2 to the position P3 and the face WF changes as it goes from the position P2 to the position P3. For this reason, the path from the position P2 to the position P3 is a path not extending along the face WF. In the present embodiment, the distance between the path from the position P2 to the position P3 and the face WF increases as it goes from the position P2 to the position P3.

In the step S10, by online teaching or offline teaching, etc., information about the orientation of the arm portion 220 of the robot 2 when the center of the ejection face FN is positioned to each of the first teaching points PT1 and the second teaching point PT2 is acquired. The teaching point information Da is generated using this information.

The first teaching points PT1 are teaching points for the first operation S31. The first teaching points PT1 lie on the path along the face WF from the position P1 to the position P2. In the example illustrated in FIG. 5, the first teaching point PT1_1 lies at the position P1, the first teaching point PT1_2 lies between the position P1 and the position P2, and the first teaching point PT1_3 lies at the position P2. The number of the first teaching points PT1 is not limited to three. The number of the first teaching points PT1 may be two, or four or more. The position of the first teaching point PT1_1 may be different from the position P1. The position of the first teaching point PT1_3 may be different from the position P2.

The second teaching point PT2 is a teaching point for the second operation S32. The second teaching point PT2 lies on the path from the position P2 to the position P3. In the example illustrated in FIG. 5, the second teaching point PT2 lies at the position P3. The number of the second teaching points PT2 is not limited to one, and may be two or more. The position of the second teaching point PT2 may be different from the position P3. However, since no ink is ejected from the head 3*a* in the second operation S32, for simpler teaching work, it is preferable if the number of the second teaching points PT2 is less than the number of the first teaching points PT1.

The teaching point information Da is acquired using the first teaching points PT1 and the second teaching point PT2 described above. The acquired teaching point information Da is used for generating the path information Db in the step S20. That is, in the step S20, as described earlier, the path information Db is generated using, for example, computer-aided design (CAD) data that represents the three-dimensional shape of the workpiece W, in addition to the teaching point information Da.

Before giving an explanation of the first operation S31 and the second operation S32, an ejection distance La and an irradiation distance Lb will now be explained with reference to FIG. 6.

Figure 6:
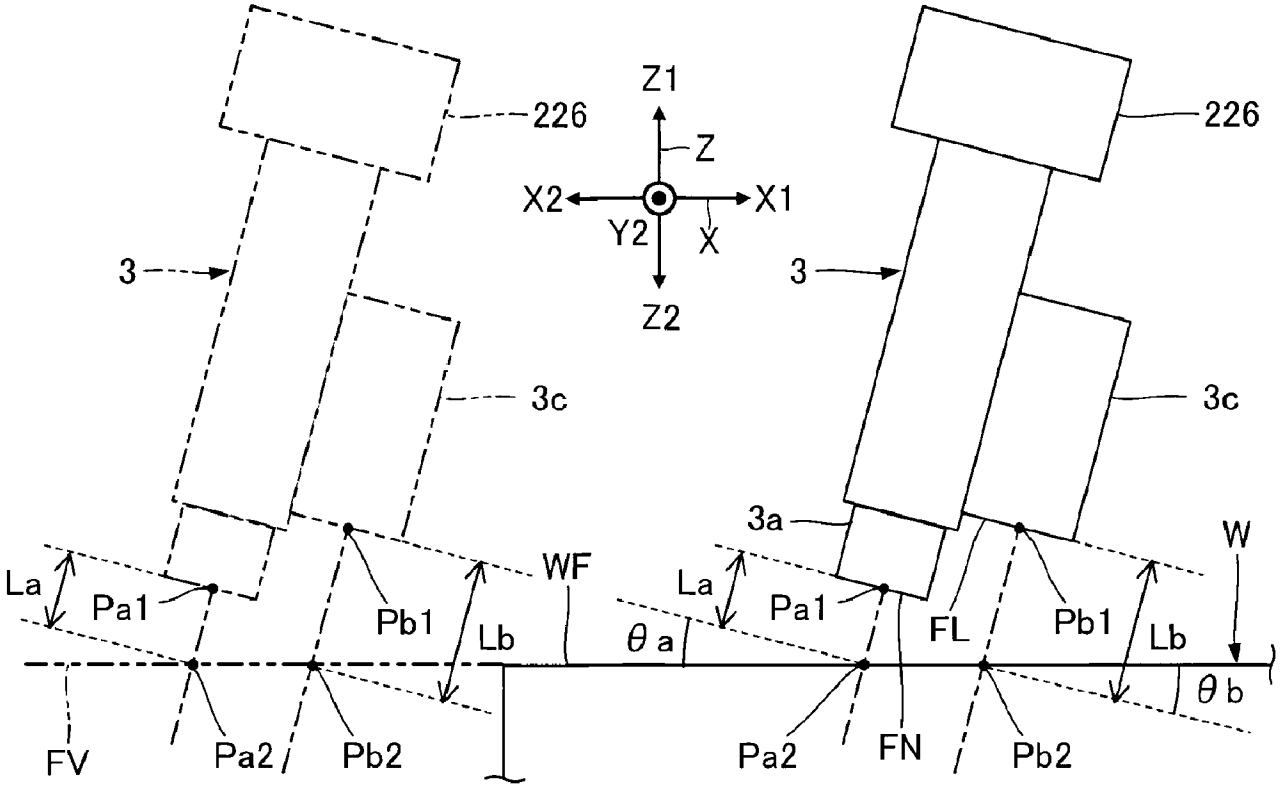
FIG. 6 is a diagram for explaining an ejection distance and an irradiation distance.

FIG. 6 is a diagram for explaining the ejection distance La and the irradiation distance Lb. For the purpose of explanation, FIG. 6 depicts a state in which the head unit 3 is in inclined orientation such that each of an ejection face FN and an emission face FL is not parallel to the face WF of the workpiece W. In the example illustrated in FIG. 6, the ejection face FN and the emission face FL are parallel to each other, and an angle θa formed by the face WF and the ejection face FN is equal to an angle θb formed by the face WF and the emission face FL. The ejection face FN and the emission face FL do not necessarily have to be parallel to each other. If so, the angle θa and the angle θb are different from each other.

The ejection distance La is the distance between the workpiece W and the ejection face FN in the direction of a line normal to the ejection face FN. In other words, when the normal line extending from the center Pa1 of the ejection face FN intersects with the face WF of the workpiece W at a point of intersection Pa2, the ejection distance La is the distance from the center Pa1 to the point of intersection Pa2. As indicated by alternate-long-and-two-short-dashes illustration in FIG. 6, when the normal line extending from the center Pa1 of the ejection face FN does not intersect with the surface of the workpiece W, the point of intersection Pa2 is the point where the normal line extending from the center Pa1 of the ejection face FN intersects with a virtual plane FV that is an extension of the face WF of the workpiece W. When the normal line extending from the center Pa1 of the ejection face FN does not intersect with the virtual plane FV as in a case of being parallel to the virtual plane FV, the ejection distance La is infinity. Under ideal conditions, the direction in which ink is ejected from the nozzles N is parallel to the direction of the line normal to the ejection face FN.

The irradiation distance Lb is the distance between the workpiece W and the emission face FL in the direction of a line normal to the emission face FL. In other words, when the normal line extending from the center Pb1 of the emission face FL intersects with the face WF of the workpiece W at a point of intersection Pb2, the irradiation distance Lb is the distance from the center Pb1 to the point of intersection Pb2. As indicated by alternate-long-and-two-short-dashes illustration in FIG. 6, when the normal line extending from the center Pb1 of the emission face FL does not intersect with the surface of the workpiece W, the point of intersection Pb2 is the point where the normal line extending from the center Pb1 of the emission face FL intersects with the virtual plane FV that is an extension of the face WF of the workpiece W. When the normal line extending from the center Pb1 of the emission face FL does not intersect with the virtual plane FV as in a case of being parallel to the virtual plane FV, the irradiation distance Lb is infinity.

In the example illustrated in FIG. 5, since the face WF of the workpiece W is a flat surface, the angle θa is defined as an angle formed by the ejection face FN and the face of the workpiece W facing the ejection face FN. If the surface of the workpiece W is curved, a virtual tangential plane set at the point of intersection Pa2 where the normal line extending from the center Pa1 of the ejection face FN meets with the surface of the workpiece W is assumed, and the angle θa is defined as an angle formed by the tangential plane and the ejection face FN. Such a virtual tangential plane can be said as a virtual plane that is an approximation of a portion, of the surface of the workpiece W, facing the ejection face FN to a flat plane. However, if the normal line extending from the center Pa1 of the ejection face FN does not intersect with the surface of the workpiece W, the angle θa is an angle formed by the virtual plane FV, which is an extension of the surface of the workpiece W, and the ejection face FN.

Figure 7:
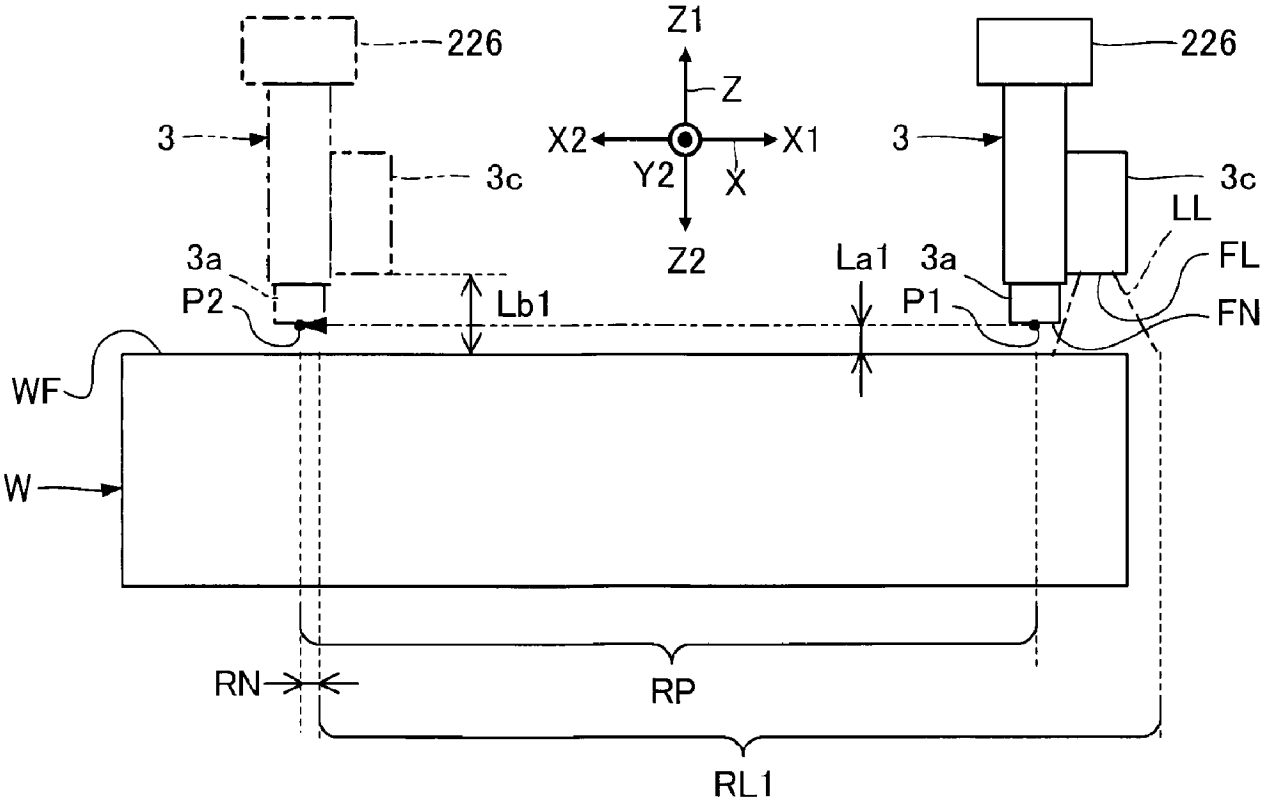
FIG. 7 is a diagram for explaining first operation according to the first embodiment.

FIG. 7 is a diagram for explaining the first operation S31 according to the first embodiment. In the first operation S31, as illustrated in FIG. 7, the robot 2 moves the head 3*a* from the position P1 to the position P2. When this operation is performed, based on the image data, the head 3*a* ejects ink toward the workpiece W, and the energy emitter 3*c* emits energy LL toward the workpiece W. In this process, the head 3*a* moves from the position P1 to the position P2 ahead of the energy emitter 3*c*. For this reason, the ink having been ejected onto the workpiece W from the head 3*a* undergoes irradiation with the energy LL emitted from the energy emitter 3*c*.

However, an irradiation range RL1, which is the maximum range of irradiation of the workpiece W with the energy LL during the execution of the first operation S31, does not correspond with a print range RP, which is the maximum range of applying the ink to the workpiece W. On the workpiece W after the execution of the first operation S31, there exists a region RN where ink that has not undergone irradiation with the energy LL could remain. The region RN is a region where the ink having been ejected from the head 3*a* last during the execution of the first operation S31 could remain.

For higher image quality, it is preferable if a first ejection distance La1, which is the ejection distance La during the execution of the first operation S31, is constant throughout the period of execution of the first operation S31. The concept of "the first ejection distance La1 is constant" does not preclude tolerable errors arising from surface irregularities formed in the face WF or caused by the operation of the robot 2. For the same reason, it is preferable if a first angle θa1, which is the angle θa during the execution of the first operation S31, is constant throughout the period of execution of the first operation S31. The concept of "the first angle θa1 is constant" does not preclude tolerable errors arising from surface irregularities formed in the face WF or caused by the operation of the robot 2. If each of the first ejection distance La1 and the first angle θa1 is constant throughout the period of execution of the first operation S31, a first irradiation distance Lb1, which is the irradiation distance Lb during the execution of the first operation S31, is constant throughout the period of execution of the first operation S31.

In the example illustrated in FIG. 7, the ejection face FN is parallel to the face WF, and the first angle θa1 is 0°. Though the first angle θa1 may be greater or less than 0°, for higher image quality, it is preferable if the first angle θa1 is within a range of ±45° inclusive.

In the first operation S31 according to the present embodiment, the head 3*a* is moved from the position P1 to the position P2 by the operation of the joints 230_2, 230_3, and 230_5 of the robot 2 while keeping each of the first ejection distance La1 and the first angle θa1 constant throughout the period of execution of the first operation S31. Any joint 230 other than the joints 230_2, 230_3, and 230_5 of the robot 2 also may operate in the first operation S31. However, not allowing the joints 230 other than the joints 230_2, 230_3, and 230_5 to operate enables the movement of the head 3*a* with high precision.

Figure 8:
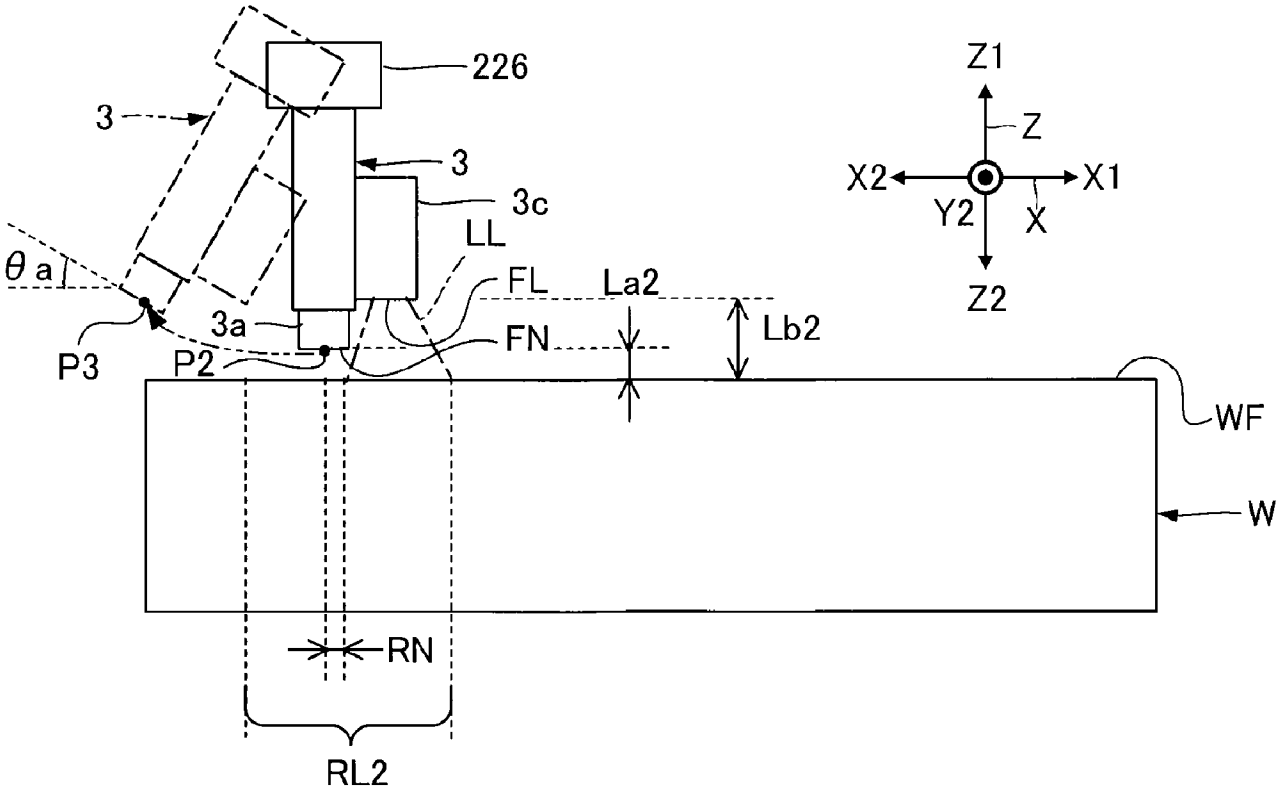
FIG. 8 is a diagram for explaining second operation according to the first embodiment.

FIG. 8 is a diagram for explaining the second operation S32 according to the first embodiment. In the second operation S32, as illustrated in FIG. 8, the robot 2 moves the head 3*a* from the position P2 to the position P3. When this operation is performed, the energy emitter 3*c* emits the energy LL toward the workpiece W, without the ejection of ink from the head 3*a* toward the workpiece W. For this reason, the ink remaining at the above-mentioned region RN of the workpiece W undergoes irradiation with the energy LL emitted from the energy emitter 3*c*. That is, an irradiation range RL2, which is the maximum range of irradiation of the workpiece W with the energy LL during the execution of the second operation S32, includes the region RN.

The second operation S32 is subsequent to the first operation S31 in the same printing pass as that of the first operation S31. The term "printing pass" means a series of operations comprised of ink ejection by the head 3*a* and energy emission by the energy emitter 3*c*, including neither of line-feed operation of shifting the movement path of the head 3*a* in the width direction and return operation of switching the moving direction of the head 3*a* to the opposite direction.

A second irradiation distance Lb2, which is the irradiation distance Lb during the execution of the second operation S32, is different from the first irradiation distance Lb1 described earlier in at least a part of its period. In the present embodiment, the second irradiation distance Lb2 is equal to the first irradiation distance Lb1 immediately after the second operation S32 starts but becomes greater than the first irradiation distance Lb1 in the process of execution of the second operation S32. Specifically, the second irradiation distance Lb2 increases progressively as the head 3*a* goes from the position P2 toward the position P3. As described here, the amount of change in the second irradiation distance Lb2 is larger than the amount of change in the first irradiation distance Lb1. That is, the amount of change in the first irradiation distance Lb1 is smaller than the amount of change in the second irradiation distance Lb2. In the present embodiment, although no ink is ejected from the head 3*a* during the execution of the second operation S32, a second ejection distance La2, which is the ejection distance La during the execution of the second operation S32, is different from the first ejection distance La1 described earlier in accordance with the change in the second irradiation distance Lb2. Specifically, the second ejection distance La2 increases progressively as the head 3*a* goes from the position P2 toward the position P3.

In the second operation S32 according to the present embodiment, the head 3*a* is moved from the position P2 to the position P3 by the operation of the joint 230_5 of the robot 2 such that the second irradiation distance Lb2 increases. Any joint 230 other than the joint 230_5 of the robot 2 may operate in the second operation S32.

The joint 230_5 is the one whose amount of rotation during the execution of the second operation S32 is the largest of the plurality of joints 230. The joint 230_3 is the one whose amount of rotation during the execution of the first operation S31 is the largest of, among the plurality of joints 230, rotatable portions closer to the pedestal portion 210 than the joint 230_5 is. Let R11 be the amount of rotation of the joint 230_5 during the execution of the first operation S31. Let R12 be the amount of rotation of the joint 230_3 during the execution of the first operation S31. Let R21 be the amount of rotation of the joint 230_5 during the execution of the second operation S32. Let R22 be the amount of rotation of the joint 230_3 during the execution of the second operation S32. Given these definitions, the following inequality holds: R21/R22>R11/R12. The gist is that the joints 230 as a whole are rotated during the execution of the first operation S31, whereas, among the joints 230, the one that is close to the distal end of the arm portion 220 is mainly rotated during the execution of the second operation S32. For this reason, even if the arm portion 220 after the first operation S31 is in a fully-stretched state, the region RN where ink having not undergone irradiation with the energy LL could remain can be irradiated with the energy LL in the second operation S32. Moreover, it is possible to control the position and orientation of the head 3*a* during the execution of the first operation S31 with high precision and, in addition, reduce wasteful motion of the robot 2 during the execution of the second operation S32.

A second angle θa2, which is the angle θa formed by the ejection face FN and the face of the workpiece W facing the ejection face FN during the execution of the second operation S32, is different from the first angle θa1 described earlier. In the present embodiment, the second angle θa2 is larger than the first angle θa1. Specifically, the second angle θa2 increases progressively as the head 3*a* goes from the position P2 toward the position P3. As described here, the amount of change in the second angle θa2 is larger than the amount of change in the first angle θa1. That is, the amount of change in the first angle θa1 is smaller than the amount of change in the second angle θa2.

The "amount of change in the first angle θa1" may be an average amount of change in the first angle θa1 in the period of execution of the first operation S31, or may be a difference between the maximum value and the minimum value of the first angle θa1 during the execution of the first operation S31. Similarly, the "amount of change in the second angle θa2" may be an average amount of change in the second angle θa2 in the period of execution of the second operation S32, or may be a difference between the maximum value and the minimum value of the second angle θa2 during the execution of the second operation S32.

In the present embodiment, in the second operation S32, the orientation of the head 3*a* changes such that the emission face FL gets tilted toward the side toward which the head 3*a* moves during the execution of the first operation S31. That is, the emission face FL is oriented in the Z2 direction at the position P2, whereas X2-directional components contained in the direction in which the emission face FL is oriented at the position P3 are more than at the position P2. The X2 direction is the direction in which the head 3*a* moves during the execution of the first operation S31.

It is preferable if the relative moving speed of the energy emitter 3*c* with respect to the workpiece W during the execution of the second operation S32 is not higher than during the execution of the first operation S31. If so, it is possible to increase the density of the energy LL applied to the ink on the workpiece W in the second operation S32 without any need for increasing the intensity of the energy LL emitted from the energy emitter 3*c*. The intensity of the energy LL emitted from the energy emitter 3*c* during the execution of the second operation S32 may be made higher than during the execution of the first operation S31.

The relative moving distance of the head 3*a* or the energy emitter 3*c* with respect to the workpiece W during the execution of the second operation S32 is less than during the execution of the first operation S31. That is, the relative moving distance of the head 3*a* or the energy emitter 3*c* with respect to the workpiece W during the execution of the first operation S31 is greater than during the execution of the second operation S32.

Upon the arrival of the head 3*a* at the position P3 from the position P2, the three-dimensional object printing apparatus 1 ends the second operation S32. It is preferable if the emission of the energy LL from the energy emitter 3*c* is stopped after the end of the second operation S32.

The three-dimensional object printing method described above is performed using the three-dimensional object printing apparatus 1 as described earlier. The three-dimensional object printing apparatus 1 includes, as described earlier, the head 3*a*, the energy emitter 3*c*, and the robot 2, which is an example of "moving mechanism". The head 3*a* has the ejection face FN in which the nozzles N for ejecting ink, an example of "liquid", are provided. The energy emitter 3*c* has the emission face FL from which energy for curing or solidifying the ink having been ejected from the head 3*a* is emitted. The robot 2 changes the relative position of the head 3*a* and the energy emitter 3*c* with respect to the three-dimensional workpiece W.

The three-dimensional object printing apparatus 1 executes the first operation S31 and the second operation S32. That is, the three-dimensional object printing method using the three-dimensional object printing apparatus 1 includes the first operation S31 and the second operation S32.

In the first operation S31, ejection of ink toward the workpiece W by the head 3*a*, emission of energy toward the workpiece W by the energy emitter 3*c*, and relative movement of the head 3*a* and the energy emitter 3*c* with respect to the workpiece W by the robot 2, are performed concurrently. In the second operation S32 subsequent to the first operation S31 in the same printing pass as that of the first operation S31, emission of energy toward the workpiece W by the energy emitter 3*c* and relative movement of the head 3*a* and the energy emitter 3*c* with respect to the workpiece W by the robot 2 are performed concurrently, and ejection of ink toward the workpiece W by the head 3*a* is not performed.

The first irradiation distance Lb1, which is the distance between the workpiece W and the emission face FL in the direction of a line normal to the emission face FL during the execution of the first operation S31, and the second irradiation distance Lb2, which is the distance between the workpiece W and the emission face FL in the direction of a line normal to the emission face FL during the execution of the second operation S32, are different from each other.

In the three-dimensional object printing method described above or in the three-dimensional object printing apparatus 1, since the ejection of ink toward the workpiece W by the head 3*a* and the relative movement of the head 3*a* and the energy emitter 3*c* with respect to the workpiece W by the robot 2 are performed concurrently in the first operation S31, it is possible to apply the ink throughout the regional range of the workpiece W to which the ink needs to be applied. Since the emission of energy toward the workpiece W by the energy emitter 3*c* is also performed concurrently therewith in the first operation S31, it is possible to apply the energy to the ink on the workpiece W throughout the most part of the regional range of the workpiece W which needs to be irradiated.

Furthermore, the second operation S32 is subsequent to the first operation S31 in the same printing pass as that of the first operation S31. In the second operation S32, since the emission of energy toward the workpiece W by the energy emitter 3*c* and the relative movement of the head 3*a* and the energy emitter 3*c* with respect to the workpiece W by the robot 2 are performed concurrently, it is possible to apply the energy also to, of the ink having been ejected onto the workpiece W in the first operation S31, the part having not undergone irradiation with the energy in the first operation S31. That is, in the second operation S32, it is possible to apply the energy also to the ink having been ejected from the head 3*a* last during the execution of the first operation S31. Moreover, since the ejection of ink toward the workpiece W by the head 3*a* is not performed in the second operation S32, it is possible to prevent ink having not undergone irradiation with the energy from remaining on the workpiece W after the execution of the second operation S32.

Furthermore, since the first irradiation distance Lb1 and the second irradiation distance Lb2 are different from each other, even if the operation of the robot 2 is restricted during the execution of the second operation S32 due to the limit in the operable range of the robot 2 or due to the presence of an obstacle, etc., it is possible to apply energy to the ink remaining on the workpiece W without having been irradiated with the energy after the execution of the first operation S31. Applying the energy in this way makes it possible to cure or solidify the ink on the workpiece W properly.

As described earlier, the amount of change in the first irradiation distance Lb1 is smaller than the amount of change in the second irradiation distance Lb2. Therefore, it is possible to make the amount of change in the first ejection distance La1 smaller than the amount of change in the second ejection distance La2. This results in higher image quality, as compared with a configuration in which the amount of change in the first irradiation distance Lb1 is larger than the amount of change in the second irradiation distance Lb2. As described earlier, the first ejection distance La1 is the distance between the workpiece W and the ejection face FN in the direction of a line normal to the ejection face FN during the execution of the first operation S31. The second ejection distance La2 is the distance between the workpiece W and the ejection face FN in the direction of a line normal to the ejection face FN during the execution of the second operation S32.

As described earlier, it is preferable if the first ejection distance La1, which is the distance between at least a part of the ejection face FN and the workpiece W in the direction in which ink is ejected from the nozzles N during the execution of the first operation S31, is constant throughout the period of execution of the first operation S31. If so, it is possible to enhance image quality easily. If the surface of the workpiece W is curved or bent, in some instances it might be practically difficult to keep the distance from the workpiece W constant throughout the entire region of the ejection face FN, which is substantially flat.

In the present embodiment, as described earlier, the second irradiation distance Lb2 is greater than the first irradiation distance Lb1. Therefore, during the execution of the second operation S32, when there exists an object such as an obstacle on the workpiece W or ahead thereof in the direction in which the head 3*a* moves, it is possible to apply energy to the ink remaining on the workpiece W without having been irradiated with the energy after the execution of the first operation S31 while avoiding the collision of the head 3*a*, etc. with the object.

As described earlier, it is preferable if the relative moving speed of the energy emitter 3*c* with respect to the workpiece W during the execution of the second operation S32 is not higher than during the execution of the first operation S31. If so, even when the second irradiation distance Lb2 is greater than the first irradiation distance Lb1, it is possible to reduce the difference between the amount of energy applied to ink on the workpiece W during the execution of the first operation S31 and the amount of energy applied to ink on the workpiece W during the execution of the second operation S32.

In the present embodiment, as described earlier, the first angle Gal, which is the angle formed by the ejection face FN and the face of the workpiece W facing the ejection face FN during the execution of the first operation S31, and the second angle θa2, which is the angle formed by the ejection face FN and the face of the workpiece W facing the ejection face FN during the execution of the second operation S32, are different from each other. Compared with a case where the first angle θa1 and the second angle θa2 are equal to each other, therefore, it is possible to make the first irradiation distance Lb1 and the second irradiation distance Lb2 different from each other while ensuring a smaller change in position of the head 3*a* and the energy emitter 3*c*.

As described earlier, compared with a case where the amount of change in the first angle θa1 is larger than the amount of change in the second angle θa2, if the amount of change in the first angle θa1 is smaller than the amount of change in the second angle θa2, it is easier to make the amount of change in the first ejection distance La1 smaller than the amount of change in the second ejection distance La2. Therefore, in comparison with a configuration in which the amount of change in the first angle θa1 is larger than the amount of change in the second angle θa2, advantageously, it is easier to enhance image quality.

The "amount of change in the first angle θa1" may be an average amount of change in the first angle θa1 in the period of execution of the first operation S31, or may be a difference between the maximum value and the minimum value of the first angle θa1 during the execution of the first operation S31. Similarly, the "amount of change in the second angle θa2" may be an average amount of change in the second angle θa2 in the period of execution of the second operation S32, or may be a difference between the maximum value and the minimum value of the second angle θa2 during the execution of the second operation S32.

As described earlier, if the first angle θa1 is constant throughout the period of execution of the first operation S31, image quality will be higher than in a configuration in which the first angle θa1 changes during the execution of the first operation S31.

In the present embodiment, as described earlier, in the second operation S32, the orientation of the head 3*a* changes such that the emission face FL gets tilted toward the side toward which the head 3*a* moves during the execution of the first operation S31. For this reason, it is possible to irradiate a wide area on the workpiece W with energy in the second operation S32 while making an amount of movement of the energy emitter 3*c* in the second operation S32 small. Moreover, when the arm portion 220 of the robot 2 is changed from a bent state into a stretched state during a printing pass, even if the arm portion 220 is in a fully-stretched state, it is possible to irradiate a wide area on the workpiece W with energy in the second operation S32.

As described earlier, the relative moving distance of the head 3*a* or the energy emitter 3*c* with respect to the workpiece W during the execution of the first operation S31 is greater than during the execution of the second operation S32. For this reason, it is possible to perform printing over a wide area on the workpiece W while reducing wasteful motion of the robot 2.

As described earlier, the three-dimensional object printing method includes a step of acquiring the teaching point information Da before the first operation S31. The teaching point information Da is information about the first teaching point PT1 for the first operation S31 and the second teaching point PT2 for the second operation S32. The number of the second teaching point(s) PT2 is less than the number of the first teaching points PT1. Compared with a case where the number of the second teaching points is greater than the number of the first teaching point(s), therefore, the generation of the path information Db about the movement path of the head 3*a* or the energy emitter 3*c* is easier.

As described earlier, the robot 2 includes the pedestal portion 210 and the arm portion 220 supported on the pedestal portion 210. The head 3*a* and the energy emitter 3*c* are supported on the distal end of the arm portion 220. The plurality of joints 230, an example of "a plurality of rotatable portions", is provided on the pedestal portion 210 and the arm portion 220. The plurality of joints 230 changes the position and orientation of the head 3*a* and the energy emitter 3*c* with respect to the pedestal portion 210. The joint 230_5, the one whose amount of rotation during the execution of the second operation S32 is the largest of the plurality of joints 230, is an example of "first rotatable portion". The joint 230_3, the one whose amount of rotation during the execution of the first operation S31 is the largest of, among the plurality of joints 230, rotatable portions closer to the pedestal portion 210 than the joint 230_5 is, is an example of "second rotatable portion".

Let R11 be the amount of rotation of the joint 230_5 during the execution of the first operation S31. Let R12 be the amount of rotation of the joint 230_3 during the execution of the first operation S31. Let R21 be the amount of rotation of the joint 230_5 during the execution of the second operation S32. Let R22 be the amount of rotation of the joint 230_3 during the execution of the second operation S32. Given these definitions, the following inequality holds: R21/R22>R11/R12. For this reason, even if the arm portion 220 after the first operation S31 is in a fully-stretched state, the region RN where ink having not undergone irradiation with the energy LL could remain can be irradiated with the energy LL in the second operation S32. Moreover, it is possible to control the position and orientation of the head 3*a* during the execution of the first operation S31 with high precision and, in addition, reduce wasteful motion of the robot 2 during the execution of the second operation S32.

2. Second Embodiment

A second embodiment of the present disclosure will now be explained. In the exemplary embodiment described below, the same reference numerals as those used in the description of the first embodiment are assigned to components that are the same in operation and function as those in the first embodiment, and a detailed explanation of them is omitted.

Figure 9:
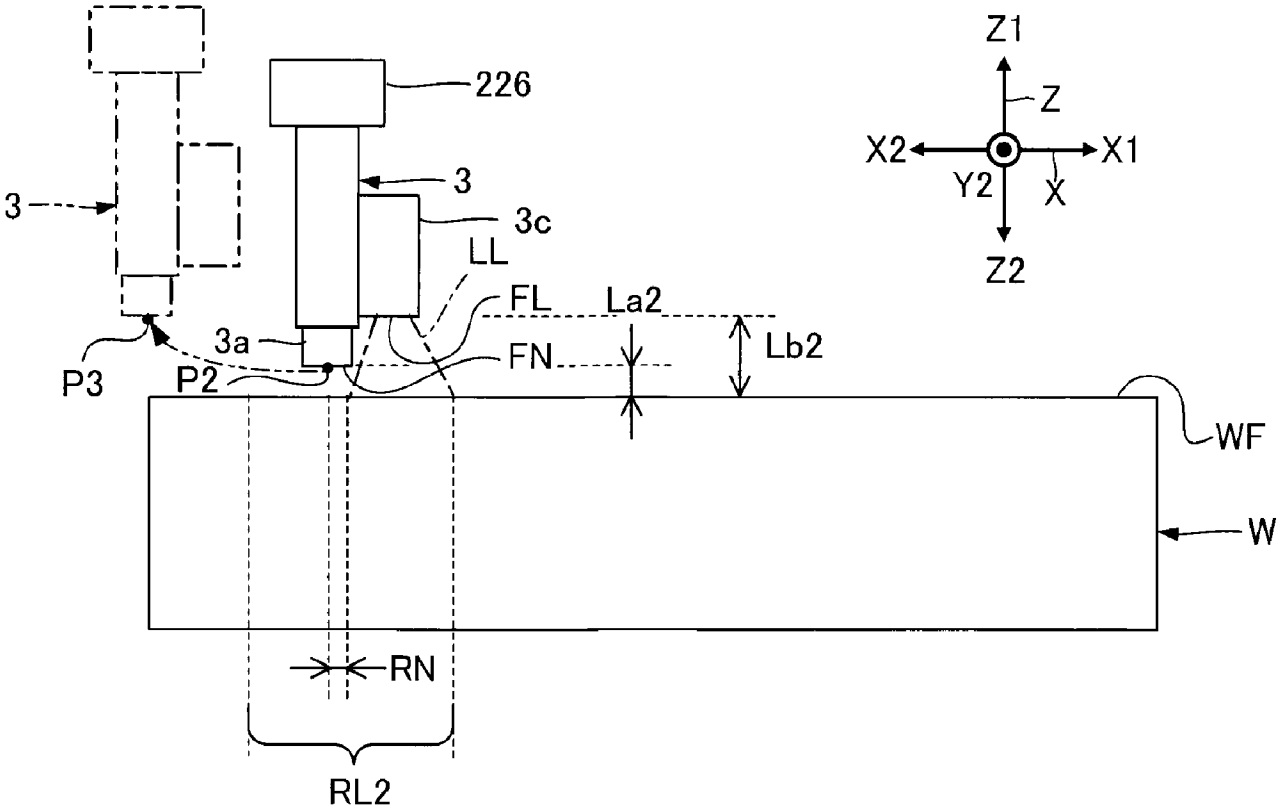
FIG. 9 is a diagram for explaining second operation according to a second embodiment.

FIG. 9 is a diagram for explaining the second operation according to the second embodiment. Except for a difference in the second operation, the present embodiment is the same as the first embodiment described above. The second operation according to the present embodiment is the same as the second operation S32 according to the first embodiment except that the orientation of the head unit 3 does not change. That is, in the second operation according to the present embodiment, the position of the head 3*a* changes from the position P2 to the position P3 while the orientation of the head 3*a* and the energy emitter 3*c* is kept constant. The second embodiment described above also makes it possible to cure or solidify the ink on the workpiece W properly. With the second operation according to the present embodiment, for example, when there exists a non-illustrated obstacle on the X2-directional side with respect to the workpiece W, it is possible to avoid the collision of the head unit 3 with the obstacle. The position P3 according to the present embodiment may be different from the position P3 according to the first embodiment.

3. Third Embodiment

A third embodiment of the present disclosure will now be explained. In the exemplary embodiment described below, the same reference numerals as those used in the description of the first embodiment are assigned to components that are the same in operation and function as those in the first embodiment, and a detailed explanation of them is omitted.

Figure 10:
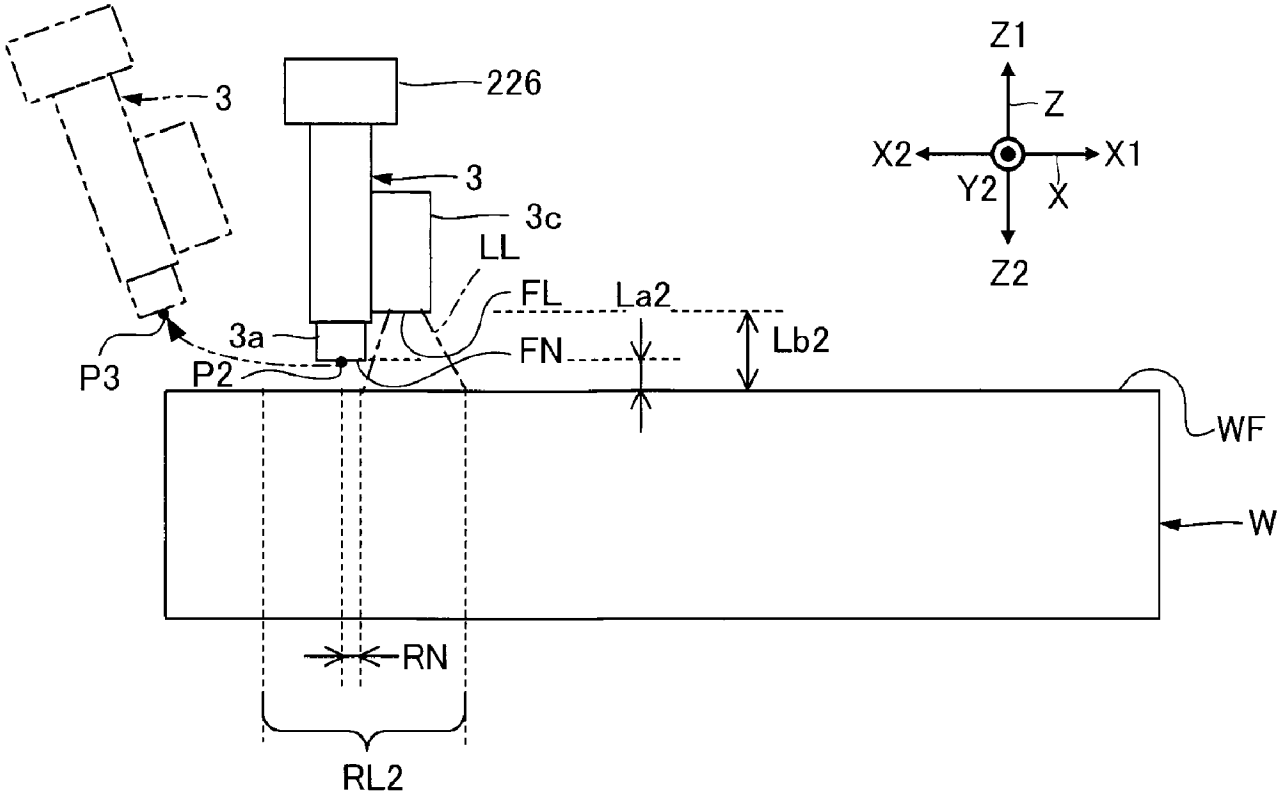
FIG. 10 is a diagram for explaining second operation according to a third embodiment.

FIG. 10 is a diagram for explaining the second operation according to the third embodiment. Except for a difference in the second operation, the present embodiment is the same as the first embodiment described earlier. The second operation according to the present embodiment is the same as the second operation S32 according to the first embodiment except that the orientation of the head unit 3 changes toward the side that is the opposite of that of the first embodiment. In the present embodiment, the orientation of the head 3*a* in the second operation S32 changes such that the emission face FL gets tilted toward the side opposite of the side toward which the head 3*a* moves during the execution of the first operation S31. That is, the emission face FL is oriented in the Z2 direction at the position P2, whereas X1-directional components contained in the direction in which the emission face FL is oriented at the position P3 are more than at the position P2. The X1 direction is the direction that is the opposite of the direction in which the head 3*a* moves during the execution of the first operation S31.

The third embodiment described above also makes it possible to cure or solidify the ink on the workpiece W properly. In the present embodiment, in the second operation, the orientation of the head 3*a* changes such that the emission face FL gets tilted toward the side opposite of the side toward which the head 3*a* moves during the execution of the first operation. For this reason, it is possible to irradiate a wide area on the workpiece W with the energy LL in the second operation while making an amount of movement of the energy emitter 3*c* in the second operation small. Moreover, it is possible to avoid wasteful energy irradiation to an area where there is no ink on the workpiece. The position P3 according to the present embodiment may be different from the position P3 according to the first embodiment.

4. Fourth Embodiment

A fourth embodiment of the present disclosure will now be explained. In the exemplary embodiment described below, the same reference numerals as those used in the description of the first embodiment are assigned to components that are the same in operation and function as those in the first embodiment, and a detailed explanation of them is omitted.

Figure 11:
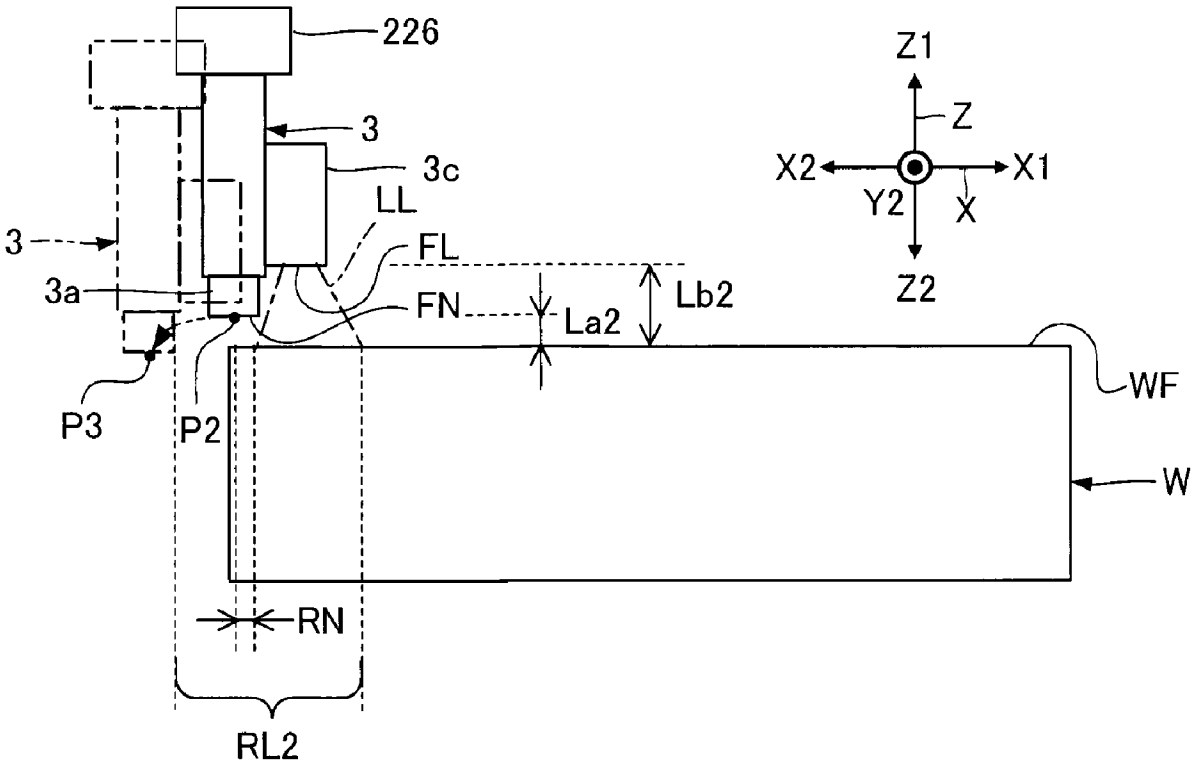
FIG. 11 is a diagram for explaining second operation according to a fourth embodiment.

FIG. 11 is a diagram for explaining the second operation according to the fourth embodiment. Except for a difference in the second operation, the present embodiment is the same as the first embodiment described earlier. The second operation according to the present embodiment is the same as the second operation S32 according to the first embodiment except that the orientation of the head unit 3 does not change and that the second irradiation distance Lb2 is less than the first irradiation distance Lb1. In the example illustrated in FIG. 11, the position P3 in the direction along the Z axis is located on the Z2-directional side relative to the position P2 in the direction along the Z axis. In the second operation according to the present embodiment, the position of the head 3*a* changes from the position P2 to the position P3 while the orientation of the head 3*a* and the energy emitter 3*c* is kept constant.

The fourth embodiment described above also makes it possible to cure or solidify the ink on the workpiece W properly. In the present embodiment, as described earlier, the second irradiation distance Lb2 is less than the first irradiation distance Lb1. For this reason, it is possible to increase the density of the energy LL applied to the ink on the workpiece W in the second operation without any need for increasing the intensity of the energy LL emitted from the energy emitter 3*c*. Consequently, it is possible to cure or solidify the ink on the workpiece W sufficiently in the second operation without any need for reducing the moving speed of the energy emitter 3*c* in the second operation. The distance from the position P2 to the position P3 according to the present embodiment may be different from the distance from the position P2 to the position P3 according to the first embodiment.

5. Modification Examples

The embodiments described as examples above can be modified in various ways. Some specific examples of modification that can be applied to the embodiments described above are described below. Any two or more modification examples selected from the description below may be combined as long as they are not contradictory to each other or one another.

5-1. First Modification Example

In the foregoing embodiments, a configuration using a six-axis vertical multi-articulated robot as a moving mechanism has been described so as to show examples. However, the scope of the present disclosure is not limited thereto. The moving mechanism may be, for example, a vertical multi-articulated robot other than six-axis one, or may be a horizontal multi-articulated robot. The arm portion of the robot may have an expanding/contracting mechanism or a linear-motion mechanism, etc. in addition to a rotatable portion(s) configured as a rotating mechanism. However, to strike a good balance between print quality in print operation and freedom in operation of the robot during non-printing, it is preferable if the robot is a multi-articulated robot having six axes or more.

5-2. Second Modification Example

In the foregoing embodiments, the head is fastened to the robot with screws, etc. However, the scope of the present disclosure is not limited thereto. For example, the head may be fixed to the robot by gripping the head using a gripping mechanism such as a hand mounted as an end effector on the robot.

5-3. Third Modification Example

In the foregoing embodiments, a configuration using a single kind of ink to perform printing has been described so as to show examples. However, the scope of the present disclosure is not limited thereto. The present disclosure may be applied to a configuration using two or more kinds of ink to perform printing.

5-4. Fourth Modification Example

The scope of application of a three-dimensional object printing apparatus and a three-dimensional object printing method according to the present disclosure is not limited to printing. For example, a three-dimensional object printing apparatus that ejects a colorant solution can be used as an apparatus for manufacturing a color filter of a liquid crystal display device. A three-dimensional object printing apparatus that ejects a solution of a conductive material can be used as a manufacturing apparatus for forming wiring lines and electrodes of a wiring substrate. The disclosed three-dimensional object printing apparatus may be used as a jet dispenser for applying liquid such as an adhesive to a medium.

What is claimed is:

1. A three-dimensional object printing method using a head, an energy emitter, and a moving mechanism, the head having an ejection face in which a nozzle for ejecting liquid is provided, the energy emitter having an emission face from which energy for curing or solidifying the liquid ejected from the head is emitted, the moving mechanism changing relative position of the head and the energy emitter with respect to a three-dimensional workpiece, the three-dimensional object printing method comprising:

first operation of concurrently performing ejection of liquid toward the workpiece by the head, emission of energy toward the workpiece by the energy emitter, and relative movement of the head and the energy emitter with respect to the workpiece by the moving mechanism; and second operation, subsequent to the first operation, of concurrently performing emission of energy toward the workpiece by the energy emitter and relative movement of the head and the energy emitter with respect to the workpiece by the moving mechanism, without performing ejection of liquid toward the workpiece by the head, wherein a first irradiation distance, which is a distance between the workpiece and the emission face in a direction of a line normal to the emission face during execution of the first operation, and a second irradiation distance, which is a distance between the workpiece and the emission face in a direction of a line normal to the emission face during execution of the second operation, are different from each other.

2. The three-dimensional object printing method according to claim 1, wherein, in the second operation, the energy emitter emits energy to liquid ejected from the head last during the execution of the first operation.

3. The three-dimensional object printing method according to claim 1, wherein an amount of change in the first irradiation distance is smaller than an amount of change in the second irradiation distance.

4. The three-dimensional object printing method according to claim 1, wherein, when a direction in which liquid is ejected from the nozzle is defined as an ejecting direction, a distance between at least a part of the ejection face and the workpiece in the ejecting direction is constant throughout a period of the execution of the first operation.

5. The three-dimensional object printing method according to claim 1, wherein the second irradiation distance is less than the first irradiation distance.

6. The three-dimensional object printing method according to claim 1, wherein the second irradiation distance is greater than the first irradiation distance.

7. The three-dimensional object printing method according to claim 1, wherein a relative moving speed of the energy emitter with respect to the workpiece during the execution of the second operation is not higher than during the execution of the first operation.

8. The three-dimensional object printing method according to claim 1, wherein a relative moving distance of the head or the energy emitter with respect to the workpiece during the execution of the first operation is greater than during the execution of the second operation.

9. The three-dimensional object printing method according to claim 1, further comprising:

acquiring, before the first operation, teaching point information about a first teaching point for the first operation and a second teaching point for the second operation, wherein the moving mechanism is a robot, and a number of the second teaching point is less than a number of the first teaching point.

10. The three-dimensional object printing method according to claim 1, wherein the moving mechanism is a robot including a base portion and an arm portion supported on the base portion, the head and the energy emitter are supported on a distal end of the arm portion, a plurality of rotatable portions that changes position and orientation of the head and the energy emitter with respect to the base portion is provided on the base portion and the arm portion, one whose amount of rotation during the execution of the second operation is the largest of the plurality of rotatable portions is defined as a first rotatable portion, one whose amount of rotation during the execution of the first operation is the largest of, among the plurality of rotatable portions, rotatable portions closer to the base portion than the first rotatable portion is, is defined as a second rotatable portion, and $R21/R22 > R11/R12$, where R11 is an amount of rotation of the first rotatable portion during the execution of the first operation, R12 is an amount of rotation of the second rotatable portion during the execution of the first operation, R21 is an amount of rotation of the first rotatable portion during the execution of the second operation, and R22 is an amount of rotation of the second rotatable portion during the execution of the second operation.

11. A three-dimensional object printing method using a head, an energy emitter, and a moving mechanism, the head having an ejection face in which a nozzle for ejecting liquid is provided, the energy emitter having an emission face from which energy for curing or solidifying the liquid ejected from the head is emitted, the moving mechanism changing relative position of the head and the energy emitter with respect to a three-dimensional workpiece, the three-dimensional object printing method comprising:

first operation of concurrently performing ejection of liquid toward the workpiece by the head, emission of energy toward the workpiece by the energy emitter, and relative movement of the head and the energy emitter with respect to the workpiece by the moving mechanism; and second operation, subsequent to the first operation, of concurrently performing emission of energy toward the workpiece by the energy emitter and relative movement of the head and the energy emitter with respect to the workpiece by the moving mechanism, without performing ejection of liquid toward the workpiece by the head, wherein a first angle, which is an angle formed by the ejection face and a face of the workpiece facing the ejection face during execution of the first operation, and a second angle, which is an angle formed by the ejection face and the face of the workpiece facing the ejection face during execution of the second operation, are different from each other.

12. The three-dimensional object printing method according to claim 11, wherein, in the second operation, the energy emitter emits energy to liquid ejected from the head last during the execution of the first operation.

13. The three-dimensional object printing method according to claim 11, wherein an amount of change in the first angle is smaller than an amount of change in the second angle.

14. The three-dimensional object printing method according to claim 11, wherein the first angle is constant throughout a period of the execution of the first operation.

15. The three-dimensional object printing method according to claim 11, wherein, in the second operation, orientation of the head changes such that the emission face gets tilted toward a side toward which the head moves during the execution of the first operation.

16. The three-dimensional object printing method according to claim 11, wherein, in the second operation, orientation of the head changes such that the emission face gets tilted toward a side opposite of a side toward which the head moves during the execution of the first operation.

17. A three-dimensional object printing apparatus, comprising:

a head having an ejection face in which a nozzle for ejecting liquid is provided;

an energy emitter having an emission face from which energy for curing or solidifying the liquid ejected from the head is emitted; and a moving mechanism changing relative position of the head and the energy emitter with respect to a three-dimensional workpiece, wherein first operation is performed, the first operation being an operation of concurrently performing ejection of liquid toward the workpiece by the head, emission of energy toward the workpiece by the energy emitter, and relative movement of the head and the energy emitter with respect to the workpiece by the moving mechanism, and second operation subsequent to the first operation is performed, the second operation being an operation of concurrently performing emission of energy toward the workpiece by the energy emitter and relative movement of the head and the energy emitter with respect to the workpiece by the moving mechanism, without performing ejection of liquid toward the workpiece by the head, and a first irradiation distance, which is a distance between the workpiece and the emission face in a direction of a line normal to the emission face during execution of the first operation, and a second irradiation distance, which is a distance between the workpiece and the emission face in a direction of a line normal to the emission face during execution of the second operation, are different from each other.

* * * * *